US008740678B2

(12) United States Patent
Railkar et al.

(10) Patent No.: US 8,740,678 B2
(45) Date of Patent: Jun. 3, 2014

(54) RIDGE VENT WITH POWERED FORCED AIR VENTILATION

(75) Inventors: Sudhir Railkar, Wayne, NJ (US); Walter Zarate, Prospect Park, NJ (US); Adem Chich, Kearney, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 910 days.

(21) Appl. No.: 12/622,854

(22) Filed: Nov. 20, 2009

(65) Prior Publication Data

US 2011/0124280 A1 May 26, 2011

(51) Int. Cl.
*F24F 7/06* (2006.01)
*E04D 13/17* (2006.01)
*F24F 7/02* (2006.01)

(52) U.S. Cl.
CPC . *F24F 7/02* (2013.01); *F24F 7/025* (2013.01); *E04D 13/174* (2013.01)
USPC ..... 454/341; 454/365; 454/367

(58) Field of Classification Search
CPC ..... F24F 7/02; E04D 13/174
USPC ..... 454/341, 354, 365, 367; 52/199
See application file for complete search history.

(56) References Cited

U.S. PATENT DOCUMENTS

| | | | | | |
|---|---|---|---|---|---|
| 3,085,490 | A * | 4/1963 | Field | 52/200 |
| 4,418,685 | A * | 12/1983 | Frazier | 126/628 |
| 4,438,680 | A * | 3/1984 | Esposito | 454/341 |
| 4,616,560 | A * | 10/1986 | Esposito | 454/341 |
| 4,627,202 | A * | 12/1986 | Esposito | 52/209 |
| 5,060,901 | A * | 10/1991 | Lathrop et al. | 248/343 |
| 5,746,653 | A * | 5/1998 | Palmer et al. | 454/186 |
| 5,890,960 | A * | 4/1999 | Cronan et al. | 454/365 |
| 5,946,868 | A * | 9/1999 | Morris | 52/199 |
| 6,159,093 | A * | 12/2000 | Mihalko, III | 454/341 |
| 6,185,880 | B1 * | 2/2001 | Richardson | 52/198 |
| 6,431,972 | B1 * | 8/2002 | Folsom | 454/18 |
| 6,491,579 | B1 * | 12/2002 | O'Hagin | 454/250 |
| 6,786,815 | B1 * | 9/2004 | Folsom | 454/18 |
| 7,165,363 | B2 * | 1/2007 | Headrick et al. | 52/198 |
| 7,823,343 | B1 * | 11/2010 | Inzeo | 52/198 |
| 8,100,341 | B1 * | 1/2012 | Roderick et al. | 236/49.3 |
| 8,221,200 | B2 * | 7/2012 | Oaten | 454/186 |
| 8,393,943 | B2 * | 3/2013 | Rotter | 454/365 |
| 2002/0072324 | A1 * | 6/2002 | Strait | 454/365 |
| 2002/0100232 | A1 * | 8/2002 | Robinson et al. | 52/198 |
| 2003/0140582 | A1 * | 7/2003 | Sells | 52/198 |
| 2004/0132401 | A1 * | 7/2004 | Rotter | 454/365 |
| 2006/0035583 | A1 * | 2/2006 | Farr et al. | 454/365 |
| 2007/0213003 | A1 * | 9/2007 | Railkar et al. | 454/365 |
| 2008/0113612 | A1 * | 5/2008 | Chich et al. | 454/341 |
| 2012/0045983 | A1 * | 2/2012 | Eskola, III | 454/341 |

* cited by examiner

*Primary Examiner* — Kang Hu
*Assistant Examiner* — Anthony Kandare
(74) *Attorney, Agent, or Firm* — Womble Carlyle Sandridge & Rice LLP

(57) ABSTRACT

A ridge vent with powered forced air ventilation is configured to be installed along the ridge of a roof covering an elongated ridge slot on either side of the ridge. A blower is mounted in a blower opening formed at a predetermined location along the ridge vent on one side of the ridge and includes a blower housing forming an inlet within the attic and an outlet oriented to force air upwardly through the vent slot to be expelled through the ridge vent. A pair of baffles are hingedly secured to the blower housing adjacent its outlet and can be attached to a roof deck to secure the blower and help to isolate its outlet from the attic space below. An impeller is disposed in the housing and is driven by an electric motor.

32 Claims, 6 Drawing Sheets

RIDGE VENT WITH POWERED FORCED AIR VENTILATION

TECHNICAL FIELD

This disclosure relates generally to attic ventilation and more specifically to a ridge vent system for gable roofs that includes powered forced air ventilation.

BACKGROUND

Attic ventilation has improved significantly over time. Many types of attic vents are used for attic ventilation such as, for instance, attic fans, attic vents, and gable vents. One type of attic vent that has proven successful, particularly for gable roofs with one or more roof ridges, is the ridge vent. Ridge vents are available in many configurations. Generally, however, a ridge vent covers an open ridge slot along the apex or ridge of a gable roof. The ridge vent is configured to define a flow path for hot and/or humid attic air to exit the attic through the ridge slot and ridge vent, while preventing rainwater, snow, and insects from entering the attic. Ridge vents may be configured, for example, as an open weave mat material that is applied over the ridge slot and covered with ridge cap shingles. Cobra® ridge vent available from GAF Materials Corporation of Wayne, NJ is an example of such a ridge vent. Other ridge vents are configured with a flexible central panel that overlies the ridge slot and conforms to the shape of the ridge. The panel is spaced from the roof deck and vents are defined along the outboard edges of the panel. Hot attic air flows by convection through the ridge slot, through the space between the panel and the roof deck, and is expelled through the vents. This type of ridge vent may or may not be covered with ridge cap shingles. In general, ridge vents of all types are coupled with soffit or eave vents that compliment in net free ventilating area that of the ridge vents so that hot air exiting through the ridge vent is replaced by cool ambient air drawn in through the soffit or eave vents.

Ridge vents are efficient attic ventilators when the air in the attic is sufficiently hot to drive robust convection. There are times, however, when this is not the case, but it nevertheless is desirable that the attic be fully ventilated. For example, the temperature of the attic air may be too low to drive robust ventilation, but the humidity in the attic may be undesirably high such that attic ventilation is needed anyway. Under these and other circumstances, some other mechanism for expelling air out of the attic and drawing in fresh air through the soffit or eave vents is required. It has been proposed to mount a powered fan or blower beneath a section or sections of a ridge vent to force attic air through the ridge vent and out of the attic. Several configurations of this proposal are extant. However, most have inherent shortcomings such as expense, difficulty of installation, requirement for a specially designed ridge vent, or inapplicability to roofs with a central ridge beam along the ridge. Accordingly, there remains a need for a powered forced air ventilation system for use with ridge vents that, among other things, is easily installed by common roofers or carpenters, that operates efficiently and provides superior air flow in cubic feet per minute (Cfm), that consumes minimum electrical power, that may be installed in roofs with or without central ridge beams, and that is reliable and affordable as a roofing accessory. It is to the provision of such a powered ventilation system that the present disclosure is primarily directed.

SUMMARY

Briefly described, a ridge vent system with powered forced air ventilation includes a ridge vent configured to cover a ridge slot formed in a roof deck along a ridge of the roof. The roof ridge may have a ridge beam extending along an apex or centerline of the ridge within the attic below so that the ridge slot straddles the ridge beam. A plurality of spaced roof rafters extend downwardly at an angle from the ridge, and are attached to the ridge beam if present. The rafters support the roof deck and shingles. At least one enlarged blower opening is formed along the ridge slot on one side of the apex or centerline of the ridge between two rafters and is sized to received a powered blower lowered through the blower opening from the outside of the roof. In one embodiment, the powered blower includes a housing formed to define a blower shroud with a longitudinally extending inlet. An adjustable length throat extends upwardly from the shroud to an outlet. A tangential impeller is rotatably disposed within the shroud and an electric motor, which may be inside the housing or outside the housing, is coupled to the impeller. Application of electrical voltage to the motor, which may be supplied by solar panels or a home electrical service, spins the impeller. This causes air to be drawn in through the inlet of the shroud and expelled through the throat and out the outlet.

A pair of baffles are hingedly, foldably, or otherwise movably connected along respective sides of the outlet. To install the blower, the adjustable length throat is adjusted for the particular roof pitch; i.e. it is lengthened for steeper roof pitches and shortened for less steep roof pitches. The baffles are hinged upwardly and the blower is lowered into the blower opening so that the shroud and inlet hang below the roof deck within the attic. The baffles are then hinged downwardly and shaped if necessary so that one baffle covers the blower opening and the other extends across the apex or centerline of the roof ridge and covers the ridge slot on the other side. The baffles are then secured to the roof deck, which secures the blower in place with its inlet disposed within the attic and its outlet communicating with the outside atmosphere. The blower motor can then be connected to one or more sources of electrical power.

With the blower or blowers installed, the ridge vent is installed along the ridge of the roof in the conventional manner so that it covers the ridge slot and also covers the blower baffles at the location of each blower. In the preferred embodiment, the ridge vent is of the panel type with edge vents so that the space between the ridge vent panel and the roof forms a vent path for attic air to flow to the edges of the panel where it is vented to ambience. Operation of a blower enhances ventilation by forcibly drawing in attic air through the blower inlet within the attic and forcibly exhausting the air through the blower outlet into the space between the roof and the ridge vent panel. This forced air, then, is forced to the vents at the edges of the panel, where it is ejected into the atmosphere. The baffles on each side of the blower outlet help insure that the exhausted attic air does not simply circulate back into the attic through the ridge slot or the blower opening.

Numerous variations and embodiments of the ridge vent system of this disclosure are discussed in detail below. For example, the housing may be formed so that the impeller is disposed at an angle to the rafters to accommodate a longer impeller and thus increased air flow. Alternatively, the impeller and inlet may extend parallel to the rafters or be disposed below the rafters with the housing defining a duct or ducts that extend between the rafters and out the ridge.

Regardless of the particular embodiment, a ridge vent with powered forced air ventilation is now provided that is easily installed by relatively unskilled labor, that is relatively inexpensive, yet reliable, that is readily installed along the ridge of a roof having a central ridge beam within the attic, and that consumes a relatively small amount of electrical power during operation. These and other aspects, features, and advantages of the ridge vent system of this disclosure will be better understood upon review of the detailed description set forth below, when taken in conjunction with the accompanying drawing figures, which are briefly described as follows. It should be understood that the figures are not necessarily drawn to scale so that no limitations of the invention can legitimately be derived through measurement of features shown in the drawing figures.

DETAILED DESCRIPTION

Figure 1:
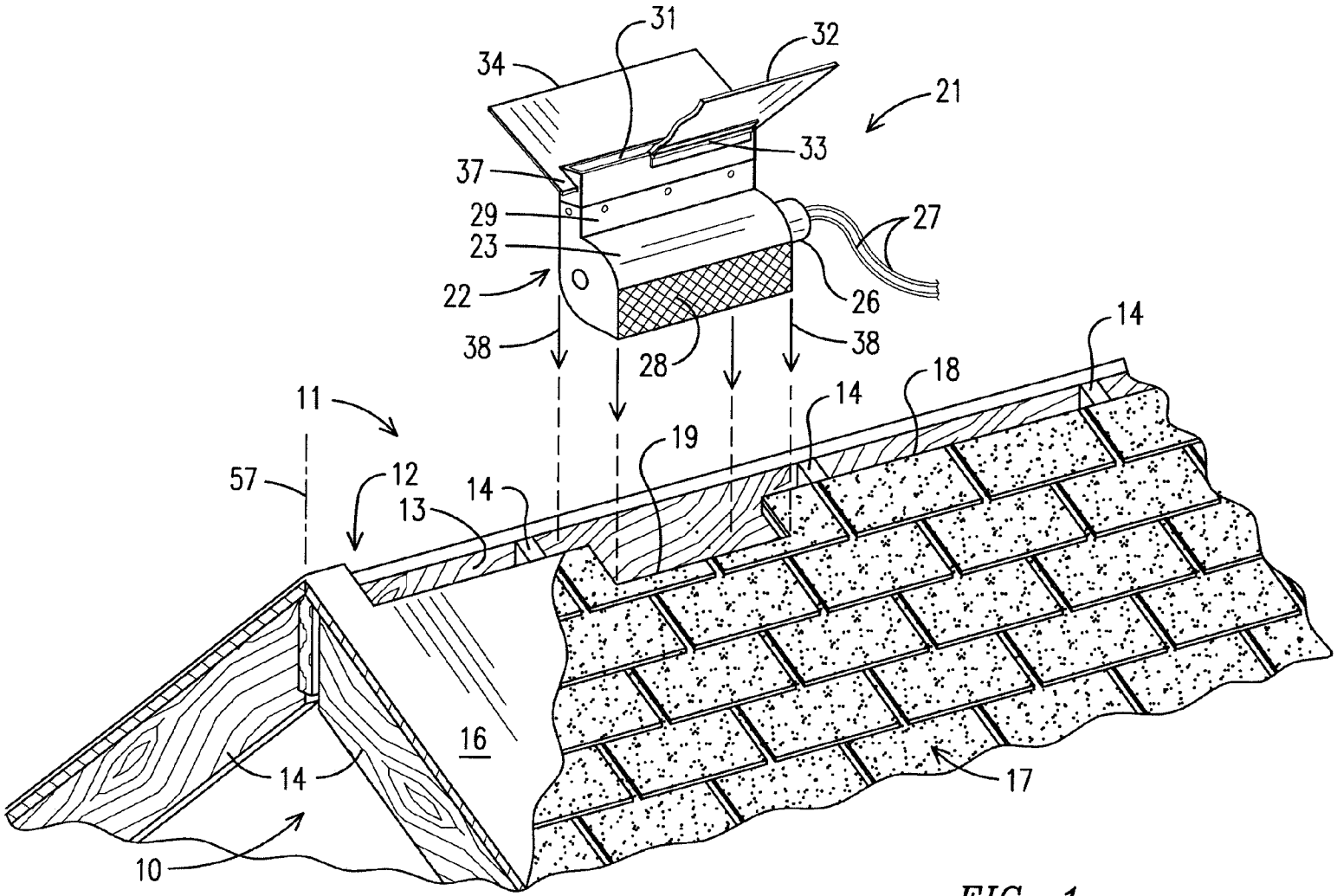
FIG. 1 is a perspective view of a portion of a roof showing the roof ridge, a ridge slot, a blower opening, and illustrating installation of one embodiment of a blower according to principles of the disclosure.

Referring now in more detail to the drawing figures, wherein like reference numerals designate like parts throughout the several views, FIG. 1 illustrates an embodiment of a blower and its installation along a roof ridge. The roof 11 overlies and bounds an attic space 10 of a dwelling or other structure. The roof 11 is of the gable design having a roof ridge 12 with an apex or centerline 57 along which a wooden ridge beam 13 extends. A plurality of roof rafters 14 are secured to the ridge beam 13 and extend downwardly at an angle on either side of the ridge. The roof rafters typically are spaced apart 16 inches on center, but may have a different spacing such as, for instance, 24 inches on center. The rafters 14 support a roof deck 16 upon which underlayment and shingles 17 are secured.

The roof 11 in FIG. 1 is prepared for installation of ridge vents along the ridge 12 of the roof. More specifically, a ridge slot 18 has been cut in the roof deck on either side of the ridge beam 13 extending along the centerline 57 of the ridge 12, and through which air within the attic 10 can escape. The ridge slot may have any desired width according to the particular ridge vent to be installed and roof pitch, but typically may be between about one inch and three inches wide on either side of the ridge beam. At a selected location between two roof rafters 14, the deck is cut to widen the ridge slot to form a blower opening 19 on one side of the ridge beam 13. The blower opening 19 is sized to receive a powered blower 21, which preferably can be installed from the top of the roof through the blower opening 19 as indicated by arrows 38 in FIG. 1.

The blower 21 illustrated in FIG. 1 is of the tangential fan type and includes a housing 22 that forms a shroud 23 within which an elongated impeller 24 (FIG. 2) is rotatably mounted. The housing also defines a blower inlet 28 through which air is drawn upon rotation of the internal impeller and the inlet may be covered with a screen as indicated to prevent ingress of insects and debris into the blower. An electric motor 26 is coupled to the impeller and configured to spin the impeller upon application of an electrical voltage, which may be supplied from solar cells atop the roof, or from the dwelling's electrical service, or either, selectively. Wires 27 connect the electric motor 26 to its source or sources of electrical power. In FIG. 1, the motor 26 is mounted externally of the housing on one end thereof; however, it also can be mounted within the housing if desired. If solar power is used to power the blower, sources of solar power, such as solar panels, can be combined or ganged together to produce incrementally increasing voltage. These incrementally higher voltages drive the blower motor at correspondingly higher speeds to draw more air from the attic and exhaust it to the atmosphere. Thus, the flow rate of the blower can be adjusted, within limits, by ganging together sources of solar power.

The housing 22 further defines a throat 29 extending upwardly from the shroud 23 and the throat 29 terminates at its upper end in an outlet 31 though which air is exhausted during operation of the blower. The throat preferably is selectively adjustable in length to accommodate roofs with steeper and shallower pitches. Alternatively, the throat may be fixed in length and sized and configured to accommodate a variety of roof pitches. A first baffle 32 is hingedly attached by a hinge 33 adjacent to and extending along one side of the outlet 31. A portion of the first baffle 32 is cut away in FIG. 1 for clarity, but it will be understood that the baffle 32 extends the entire length of the outlet 31 and, in the preferred embodiment, extends beyond the ends of the outlet 31. A second baffle 34 is hingedly attached by a hinge 36 (FIG. 3) to and extends along the opposite side of the outlet 31. Like the first baffle 32, the second baffle 34 extends beyond the ends of the outlet 31 and each baffle is provided with a pair of wings 37 that extend at least partially along the ends of the outlet 31 for purposes detailed below. The baffles 32 and 34 can be formed of any suitable material such as metal or plastic, but preferably are made of a material that can be conformed to the contours of and attached to a roof deck to mount the blower within the blower opening.

Figure 2:
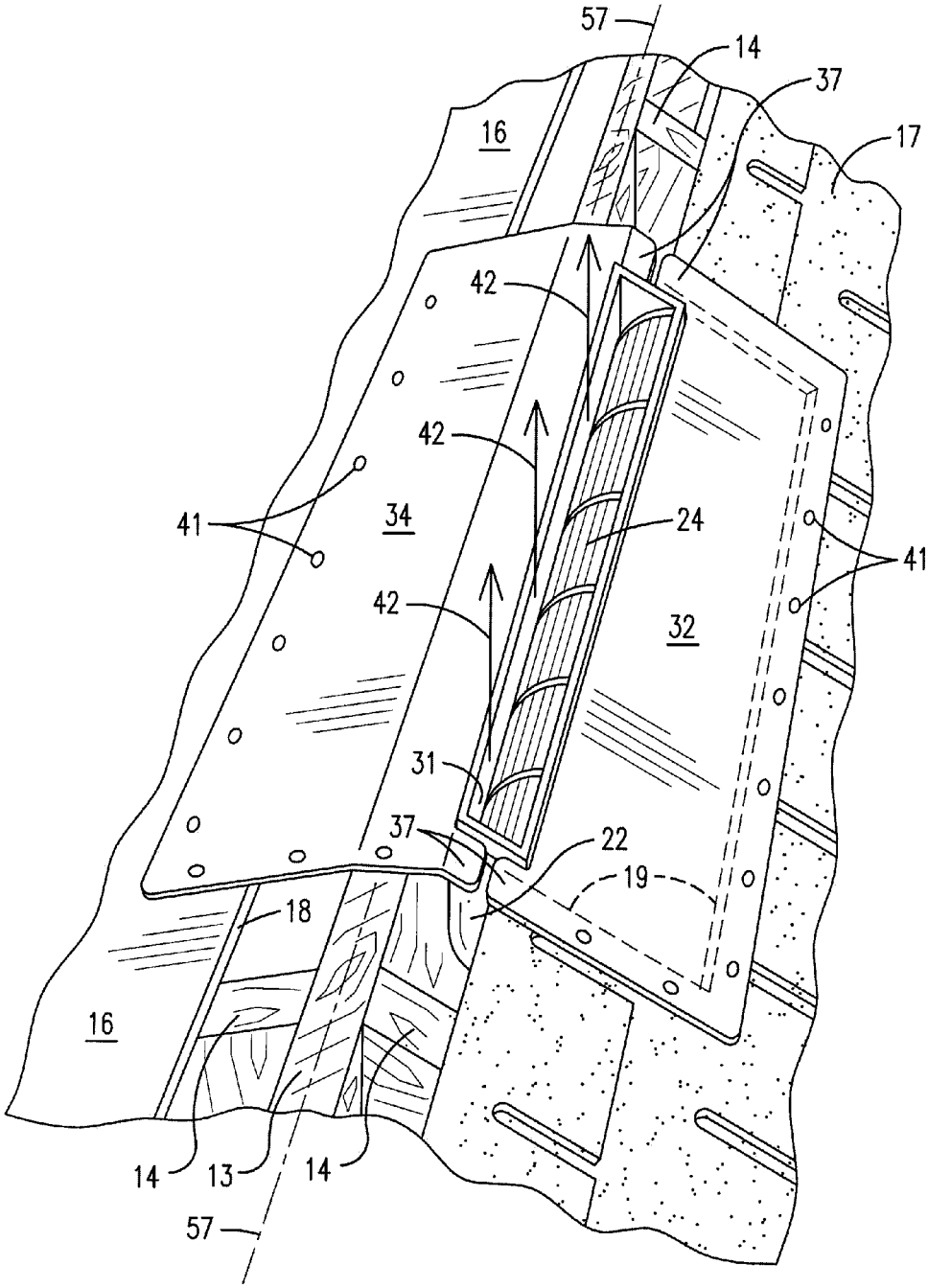
FIG. 2 is an enlarged perspective view of the roof ridge of FIG. 1 showing the blower installed within the blower opening to one side of the ridge beam.

FIG. 2 illustrates the blower assembly 21 mounted to the ridge 12 of the roof prior to installation of a ridge vent covering the ridge and the blower assembly. More specifically, the blower housing 22 has been lowered through the blower opening 19 formed in the roof deck until the outlet 31 is approximately flush with the shingles or other roofing material. The first baffle 32 has then been hinged downwardly to overly the roof deck such that baffle 32 completely covers the blower opening 19. The first baffle 32 is secured to the roof deck with appropriate fasteners such as, for example, roofing nails 41. When so positioned and attached, the wings 37 of the first baffle extend at least partially along the ends of the outlet 31 to cover any open space that may be present at these ends. The second baffle 34 also is hinged downwardly and may be bent or otherwise conformed to extend across the apex or centerline 57 of the roof ridge 12 and then downwardly at an angle to cover the ridge slot 18 on the other side of the ridge and to extend over the roof deck 16 outboard of the ridge slot. The second baffle is secured to the roof deck with appropriate fasteners such as roofing nails 41. When so positioned and attached, the wings 37 of the second baffle 34 extend at least partially along the ends of the outlet 31 toward the corresponding wings of the first baffle 32.

The wings 37 may be sufficiently long to overlap if desired, although they are shown in FIG. 2 to be shorter than this. In either event, the wings 37 cooperate to cover the ridge slot opening and any other openings that may be present at the ends of the outlet 31. Together, the first and second baffles and their wings isolate the outlet 31 of the blower assembly from the attic space below so that attic air ejected from the outlet will not tend to flow back through surrounding cracks and openings back into the attic. In FIG. 2, the impeller 24 is visible through the opening 31; however, the impeller may or may not be visible from the angle of FIG. 2 depending upon the length of the throat and the position of the impeller within the shroud. When the impeller 24 is spun by its electric motor, attic air is exhausted upwardly through the outlet 31, as indicated by arrows 42 in FIG. 2.

Figure 3:
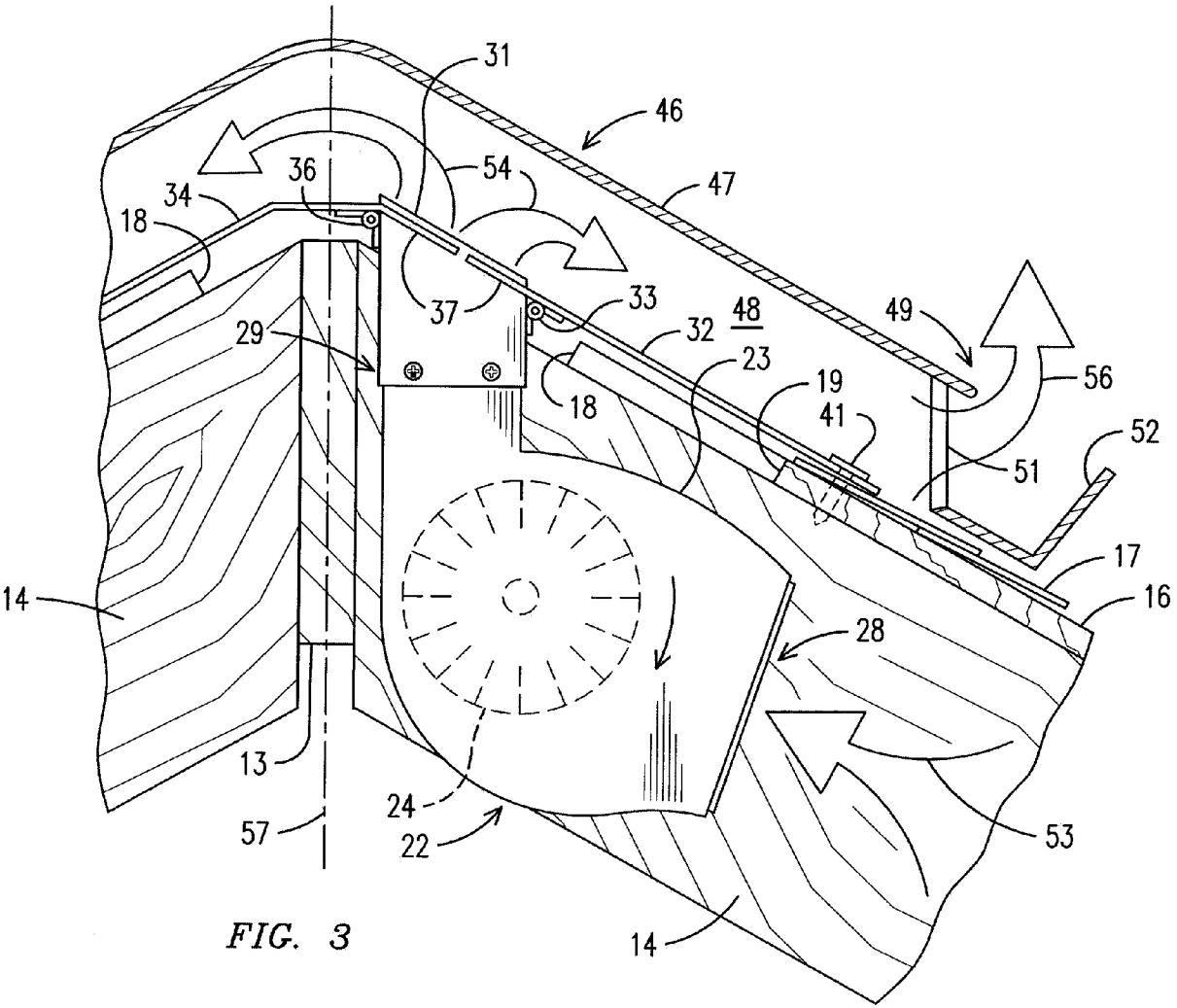
FIG. 3 is a side elevational view showing the installed blower with its inlet disposed within the attic and its outlet positioned to exhaust air beneath a ridge vent to be expelled to the atmosphere.

FIG. 3 is a view along the roof ridge showing the inside and the outside of the attic and illustrating, in an end view, the blower mounted as described above and also showing a ridge vent installed over the roof ridge covering the ridge slot and the blower. More specifically, the blower housing 22 is seen positioned within the attic to one side the apex or centerline of 57 of the ridge 12, between two roof rafters 14, and below the roof deck 16. The inlet 28 of the blower is oriented to draw in air 53 from within the attic without obstruction during operation of the blower. In this regard, the adjustable length throat 29 of the blower assembly is shortened or lengthened as necessary and locked in place to locate the shroud and the inlet at the appropriate height within the attic. For example, the throat generally will be lengthened for roofs with steeper pitches and shortened for roofs with shallower pitches so that the blower housing does not engage the bottom of the roof deck and the inlet is appropriately located beneath the roof deck.

The impeller 24 is shown in phantom lines in FIG. 3 with its rotational direction indicated by the peripheral arrow next to the impeller.

As discussed above, the blower assembly is mounted in the roof and isolated by first and second hinged baffles 32 and 34 respectively that are hingedly attached, such as by respective hinges 33 and 36, to the sides of the outlet 31. The hinged attachment of the baffles allow the baffles to be pivoted upwardly when dropping the blower housing through the blower opening and then hinged downwardly to the necessary angle to accommodate the pitch of the roof in which the blower is being installed. Wings 37 are shown in FIG. 3 to extend toward each other to cover the area at the ends of the outlet 31 with the baffles and wings helping to isolate the outlet 31 from the attic space below.

A ridge vent 46 is installed along the ridge of the roof covering the ridge slot 18, the blower outlet 31, and the baffles 32 and 34. The ridge vent in FIG. 3 is of the type that has a central panel 47 that is bent over the roof ridge and held at a distance from the roof deck by appropriate standoffs (not shown). This creates a pathway 48 for air from the attic below to move laterally toward the edge portions 49 of the ridge vent. Louvered vents 51 are provided along the edge portions 49 of the ridge vent panel and are open to the ambient atmosphere. The ridge vent may be provided with a wind baffle outboard of the louvered vents 51 to enhance draw, although ridge vents without wind baffles also are common. While a specific style and configuration of ridge vent is illustrated in FIG. 3, it should be understood that the present invention is not limited to the illustrated ridge vent, but instead may be employed with virtually any type of ridge vent including open weave mesh ridge vents such as the Cobra® ridge vent mentioned above.

Electrical power is supplied to the motor 26 (FIG. 1) either from solar panels atop the roof or atop the ridge vent, or from a homes electrical supply. Preferably, the motor 26 is a DC motor, more specifically a DC brushless motor, and, when household supply is used, the household AC voltage is rectified and regulated to provide a DC voltage of appropriate value for operating the blower. Control circuits can be provided to operate the blower on solar power when the sun is out and solar power is available and to switch to household current at night or when solar power is not otherwise available. Thermostats and/or humidistats also may be employed in the attic space 10 to switch the blower on to ventilate the attic whenever temperature and/or humidity conditions warrant. An any event, and with continued reference to FIG. 3, upon application of operating voltage to the motor, the impeller 24 spins in the direction of the arrow. The spinning impeller in conjunction with the shape of the surrounding shroud causes attic air 53 to be drawn forcibly into the inlet 28 of the blower, propelled up the throat 29, and expelled forcibly out the outlet 31 as indicated by arrows 54. This expelled attic air, then, is directed laterally beneath the central panel 47 of the ridge vent to the edges of the vent, where it is exhausted through the louvered vents 51 and to the ambient outside atmosphere, as indicated by arrow 56.

The invention having been described generally with respect to the embodiment of FIGS. 1-3, various alternate embodiments and various design details and considerations for optimizing the ridge vent with powered forced air ventilation will now be discussed with reference to the remaining figures.

Figure 4:
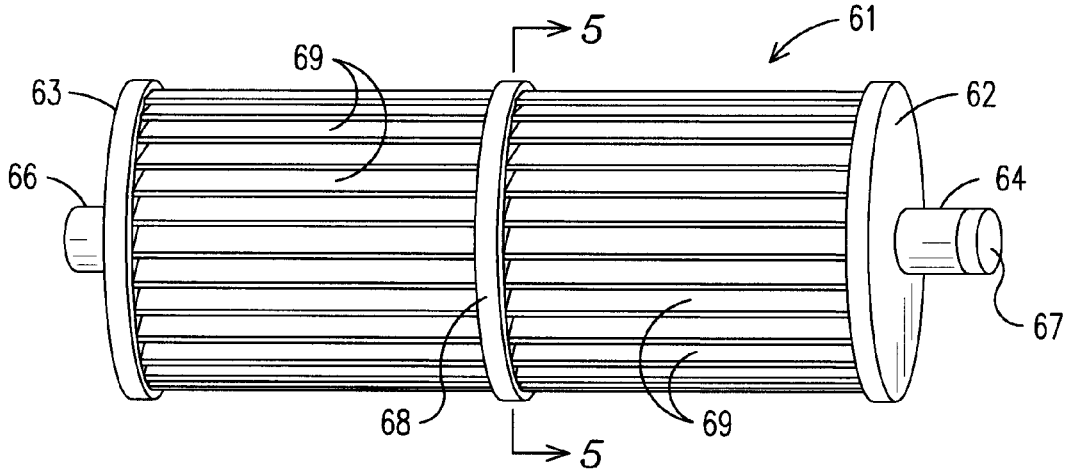
FIG. 4 is a perspective view of a preferred embodiment of an impeller configuration according to the disclosure.
Figure 5:
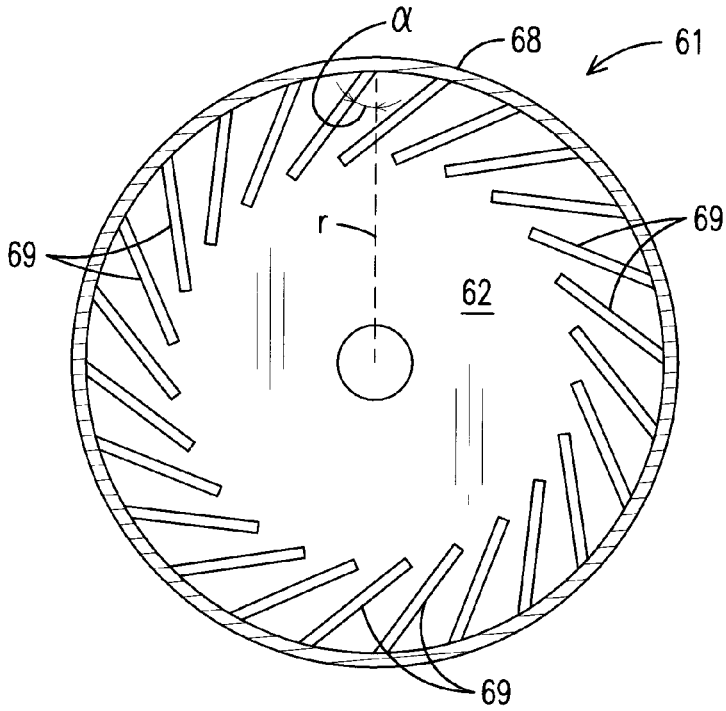
FIG. 5 is a cross sectional view taken along A-A of FIG. 4 illustrating the inclined blades of the impeller.

FIGS. 4 and 5 illustrate a preferred embodiment of an impeller for use with the blower of the present invention. The impeller 61 is generally cylindrical in overall shape and has a first end cap 62 and a second end cap 63. A first axle 64 projects axially from the first end cap 62 and a second axle 66 projects from the second end cap 63. The axles 64 and 66 are configured to be journaled within appropriate bearings at ends of the housing of the blower so that the impeller 61 is free to rotate or spin within the housing. One of the axles, axle 64 in the illustrated embodiment, includes a coupler 67 configured to couple the axle and thus the impeller to an electric motor 26 (FIG. 1) that, when activated, causes the impeller to spin. The impeller 61 further includes a plurality of longitudinally extending fins or blades 69 about its periphery and a support ring 68 is disposed between the end caps 62 and 63 for supporting the blades 69. As seen in FIG. 5, which is a cross section taken along A-A or FIG. 4, the blades 69 are generally flat and are canted at an angle a (alpha) with respect to the radius r of the impeller. While a may take on a wide range of values between zero degrees and 90 degrees within the scope of the invention, an angle of about 60 degrees has been found to provide effective and efficient ventilation and thus represents the best mode of carrying out the invention.

The impeller 61 can be fabricated of various materials including metal and plastic and can have various dimensions according to application specific requirements. However, for use in a powered ridge vent blower within the context of this disclosure, it is desired that the impeller be designed and sized such that, when the blower is in operation, it will produce a maximum cubic feet per minute (Cfm) of airflow while consuming a minimum energy. Energy consumption is particularly important where the blower is to be operated, at least part of the time, on electricity generated by solar panels.

In this regard, the inventors conducted laboratory tests using the ASHRAE 51-1999/ANSI 210-99 standard method for lab airflow measurement. The tests were conducted on blowers with metal impellers and blowers with plastic impellers. Metal impellers having a radius of 3.56 inches and lengths of 15.63, 23.5, and 15.63 inches were subjected to the test. Plastic impellers having dimensions of 3.125 inches in diameter by 12 inches long, 4.25 inches in diameter by 12 inches long, and 6.0 inches in diameter by 12 inches long were tested. The DC motors driving the impellers were powered by a variable power supply and the power, in watts, required to produce measured Cfm values was cataloged. The target was 550 Cfm of airflow using the least amount of electrical power. From these tests, the most efficient blower was a blower with a 6 inch diameter by 12 inch long plastic impeller with blades canted at an angle a of about 60 degrees. This combination produced a measured 590 Cfm of air flow, significantly more than the target flow, while consuming only 14 watts of electrical power, the least of any blower tested. Accordingly, a blower having an impeller with these dimensions and this configuration is considered by the inventors to represent the best mode of carrying out the invention.

Figure 6:
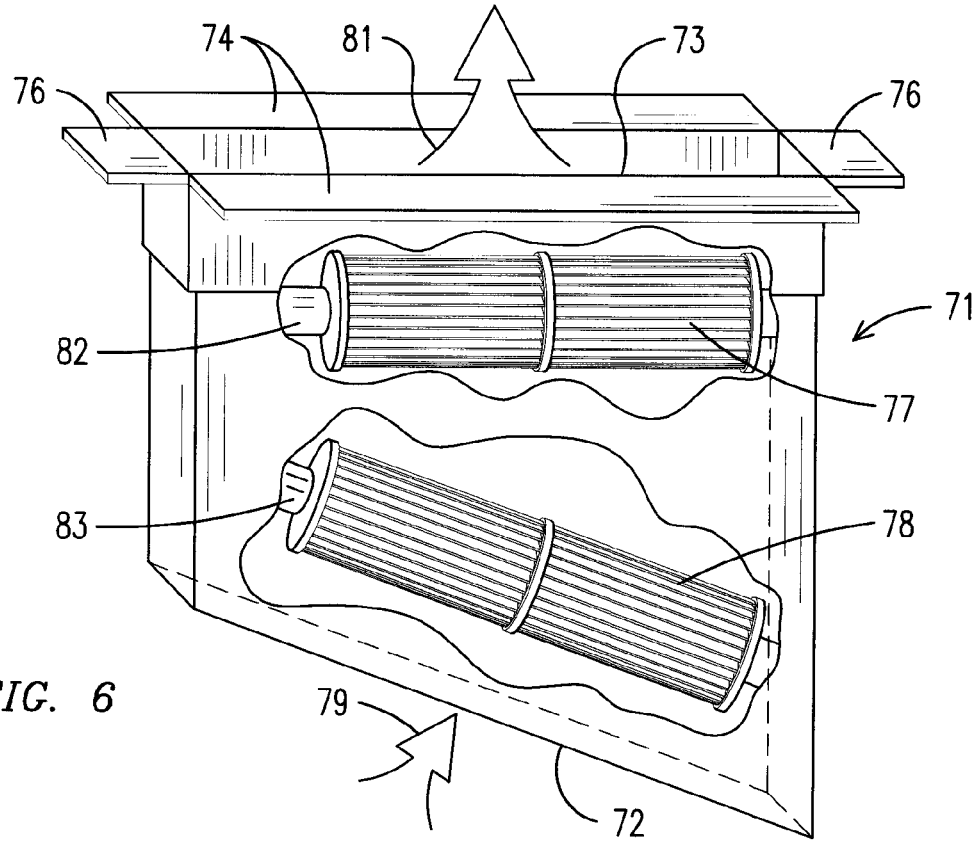
FIG. 6 is a simplified perspective view with partial cutaway portions illustrating an inclined impeller configuration of a blower assembly and the use of dual impellers.

FIG. 6 illustrates alternate embodiments of the blower according to additional aspects of the disclosure. It will be understood that FIG. 6 is a simplified conceptual drawing designed to emphasize with clarity various elements of the embodiment. A real world blower would, of course, have an appropriate shape for a blower (e.g. FIG. 1) and include appropriate shroud shapes to generate air flow and a variety of other details not illustrated in FIG. 6. FIG. 6, however, simply illustrates the blower housing conceptually as a straight rectangular housing. With this in mind, FIG. 6 shows a blower having a blower housing 71 with an inlet 72 and an outlet 73. Side baffles 74 may extend along the sides of the outlet 73 and may be hinged to the housing if desired, as discussed above. End baffles 76 also may be provided, or formed by the side baffles, for helping to isolate the outlet 73 from an attic below, also as discussed above.

In this embodiment, a pair of impellers, 77 and 78 respectively, are mounted within the housing to increase the airflow of the blower. The first impeller 77 is oriented parallel to the outlet 73 and is powered by an electric motor 82. The first impeller 77 essentially represents the configuration of FIGS. 1-3. The second impeller 78, however, is oriented at an angle with respect to the outlet 73. An angled impeller provides the advantage that the impeller can be longer than the width of the blower housing and longer than the distance between a pair of roof rafters between which the blower is mounted, with its maximum length being dependent upon the severity of the angle at which it is mounted. This, in turn, provides for an increased airflow with a housing that will nevertheless fit between a pair of roof rafters. It will be understood that the housing might contain a single parallel impeller, a single angled impeller, a pair of parallel impellers, a parallel impeller and an angled impeller, or a pair of angled impellers. Further, the impellers may be driven by separate motors as shown, or by a single motor and an appropriate drive mechanism such as, for instance, a drive belt coupling both impellers to the motor. FIG. 6 is intended to illustrate and encompass each and all of these possible configurations.

Figure 7:
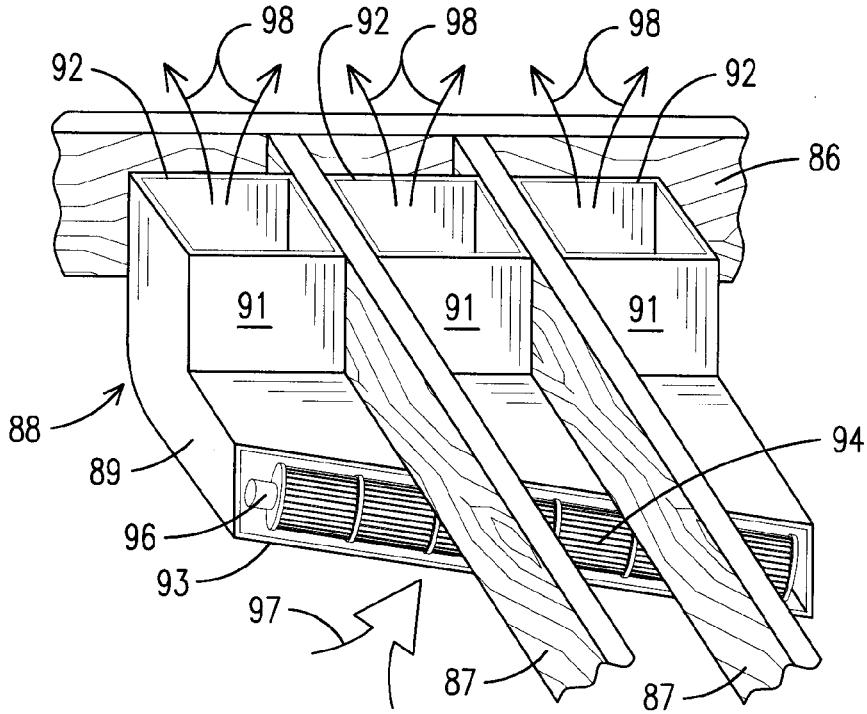
FIG. 7 is a simplified perspective view of an alternate embodiment of a ridge vent blower assembly that mounts from within the attic and spans two or more roof rafters.

FIG. 7 represents another embodiment of a ridge vent blower assembly that may be installed, not from the outside of a roof, but from within the attic. Again, this figure is a simplified conceptual drawing. Here, elements of the roof structure are illustrated including a ridge beam 86 and a plurality of roof rafters 87. Other elements of the roof, such as the roof deck, are omitted for clarity. The blower includes a blower housing 88 formed to define an inlet portion 89 and a plurality of exhaust chutes 91. The exhaust chutes have respective outlets 92 and are sized and spaced apart such that each chute fits between a pair of roof rafters 87 with the rafters extending through the spaces between the chutes. While three chutes are shown, it will be understood that more or fewer than three can be employed. The inlet portion 89 is disposed below the roof rafters and defines an inlet 93. An impeller 94 is mounted in the housing such that, when spun by motor 96, the impeller draws attic air 97 into the inlet 93 and exhausts it through the exhaust chutes, as indicated at 98. The exhausted air, then, flows through a ridge slot along the ridge of the roof and is expelled through a ridge vent covering the ridge slot. The impeller 94 is shown in FIG. 7 to be mounted at an angle relative to the rafters 87. As with the embodiment of FIG. 6, this allows the impeller to be longer than the width of the housing 88 to produce greater airflow. It will be understood that the impeller need not be mounted at such an angle and, in fact, all the combinations of number of impellers and their relative mounting angles discussed above relative to FIG. 6 are possible with the embodiment of FIG. 7.

Figure 8:
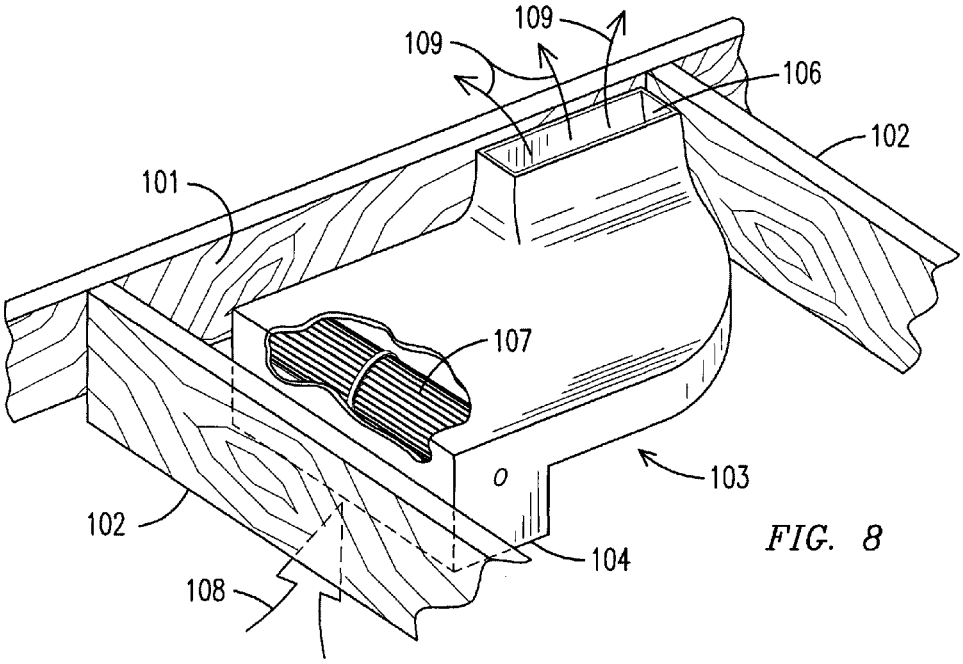
FIG. 8 is a perspective view of another alternate embodiment of a ridge vent blower assembly that mounts between roof rafters with an impeller that is oriented perpendicular to the roof ridge.

FIG. 8 illustrates yet another embodiment of a blower according to the present disclosure. A portion of the roof, including ridge beam 101 and rafters 102, is illustrated, and other portions are omitted for clarity. The blower includes a blower housing 103 configured to define an inlet 104 and an outlet 106. An impeller 107 is rotatably disposed within the housing near the inlet end and the housing is configured so that the impeller extends parallel to the roof rafters 102. In this way, the impeller can be as long as practically desired, since its length is not limited by the distance between roof rafters. An electric motor (not visible) is coupled to the impeller for spinning the impeller upon application of a voltage to the electric motor. The spinning impeller draws attic air 108 into the inlet 104 and expels it through the outlet 106, from where it travels through a ridge slot and is exhausted through an overlying ridge vent. In this embodiment, virtually any degree of airflow can be created by increasing or decreasing the length of the impeller.

Figure 9:
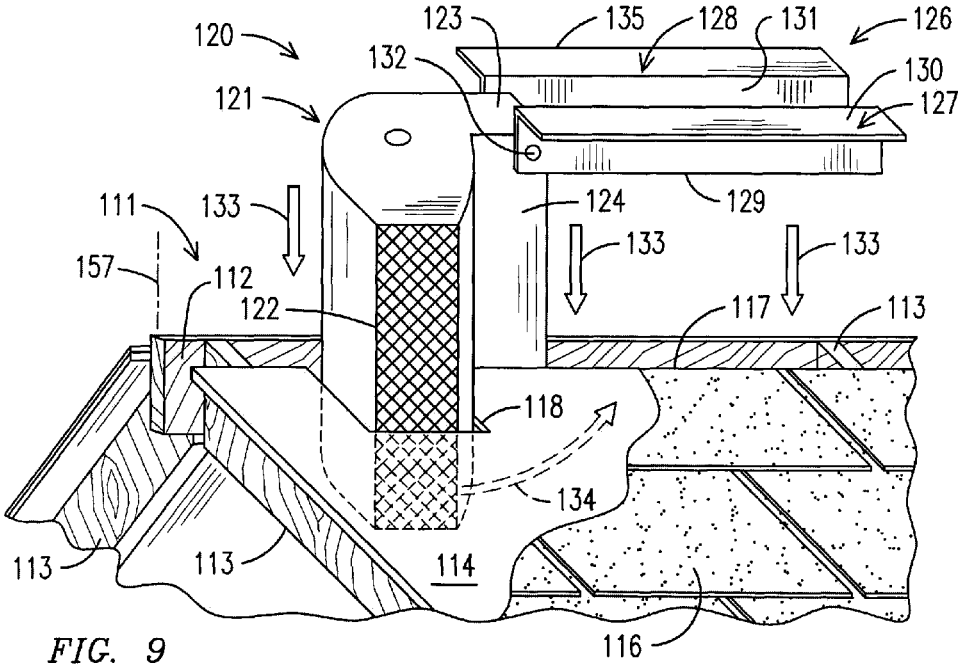
FIG. 9 is a perspective view illustrating an alternate embodiment and method of installing a ridge vent blower that requires a significantly smaller blower opening in the roof deck.

FIG. 9 illustrates an alternate embodiment of a blower that is designed to be installed through a blower opening that is significantly narrower than the width of the blower itself (see FIG. 1). A portion of a roof 111 is shown including a ridge beam 112 extending along an apex or centerline of 157 of a ridge, roof rafters 113, roof deck 114, and shingles 116. A ridge slot 117 is cut in the roof deck on either side of the ridge beam 112 in preparation for installation of a ridge vent over and extending along the ridge slot. A relatively narrow blower opening 118 is formed at a preselected location along the ridge slot for accommodating a blower 120, as detailed below. The blower 120 includes a blower housing 121 having an inlet 122, an outlet 123, and a throat 124, which may be adjustable in length to accommodate roofs of different pitches. A pair of flanges 126 are attached to the throat 124 of the blower for pivotal motion with respect thereto. More specifically, a front flange 127 is formed with a baffle 130 and a leg 129, which may be hingedly attached if desired. Similarly, a rear flange 128 has a baffle 135 and a leg 131, and these components may be hingedly attached if desired.

Each of the legs 129 and 131 of the flanges is pivotally secured to the throat 124 of the blower housing by means of a pivoting attachment 132 (only one of which is visible in FIG. 9). The pivoting attachment may be a bolt and nut, a pivot pin extending through both sides of the throat, or any other appropriate mechanism for securing the legs to the throat in a pivoting manner. With this configuration, the blower housing 121 is capable of pivoting toward and away from the flanges in the direction indicated by arrow 134. The other end of each leg 129 and 131 preferably is provided with a latching feature (not visible) that latches or that can be latched or otherwise secured to the other end of the throat when the blower housing is pivoted completely into contact with the legs of the flanges.

To install the embodiment of FIG. 9, the blower housing is pivoted to substantially a right angle with respect to the flanges 126 as illustrated in FIG. 9. In this configuration, the blower can be inserted through the narrow blower opening 118 in a vertical orientation as illustrated by arrows 133. This contrasts with insertion in the horizontal orientation shown in FIG. 1 and allows the blower opening 118 to be significantly shorter. The blower housing is inserted downwardly until the baffles 130, 135 engage the roof deck. The blower housing can then be pivoted upwardly, either from within the attic or with an appropriate tool from outside the attic, until it is parallel with the roof deck and the latching features of the legs 129 and 131 engage and latch to the opposite end of the throat 124. The latching features may be nothing more than screws or other fasteners that are applied by an installer to attach the flanges to the throat or outlet of the blower housing. At this juncture, the blower is supported beneath the roof deck by the flanges with its outlet 123 positioned to exhaust air upwardly through the ridge slot 117 to be expelled through the overlying ridge vent (not shown).

The invention has been described herein within the context of preferred embodiments and methodologies considered by the inventors to represent the best mode of carrying out the invention. It will be clear to those of skill in the art, however, that a wide range of modifications, additions, and deletions may be made to the illustrated embodiments within the scope of the invention. For instance, the baffles as well as the throat of the housing, and the housing itself, may be made of plastic and the baffles can be connected with, for example, living hinges at the outlet rather than the illustrated physical hinges. These and other variations and substitutions of elements equivalent to those illustrated herein might be made by skilled artisans without departing from the spirit and scope of the invention as set forth in the claims.

What is claimed is:

1. A roof structure comprising:

a ridge having a centerline;

a plurality of roof rafters extending downwardly from the ridge at an angle;

a roof deck supported by the roof rafters and bounding an attic below;

at least one ridge slot opening formed in the roof deck along at least a portion of the ridge and offset to one side of the centerline of the ridge, the ridge slot having an expanded portion at a predetermined location along the length thereof defining a blower opening, the blower opening having a width greater than a width of the ridge slot opening;

a blower mounted in the blower opening beneath the roof deck and offset to one side of the centerline of the ridge, the blower having an inlet disposed within the attic below and an outlet oriented to direct exhaust air away from the ridge slot opening; and a ridge vent covering and extending along the ridge slot opening;

the blower, when operating, drawing air from the attic through its inlet, channeling the air upwards along the one side of the centerline of the ridge, and directing the air away from the ridge slot opening to be exhausted to the environment through the ridge vent.

2. The roof structure of claim 1 and wherein the blower is a tangential fan containing an internal impeller.

3. The roof structure of claim 2 and wherein the impeller is generally cylindrical.

4. The roof structure of claim 2 and wherein the impeller has a plurality of blades with ends extending about the peripheral portion of the impeller.

5. The roof structure of claim 4 and wherein the impeller has a radial direction and wherein at least some of the plurality of blades are oriented at angles with respect to the radial direction.

6. The roof structure of claim 5 and wherein the angle is between about zero degrees and about ninety degrees.

7. The roof structure of claim 6 and wherein the angle is about sixty degrees.

8. The roof structure of claim 1 and further comprising at least one support baffle disposed about the outlet of the blower and extending lengthwise beyond the ends of the outlet.

9. The roof structure of claim 8 and wherein the at least one support baffle comprises a pair of support baffles on either side of the outlet of the blower, the support baffles extending lengthwise beyond the ends of the outlet and extending inwardly to form baffle wings proximate the ends of the outlet, the support baffles and baffle wings of the support baffles together substantially surrounding the outlet to isolate the outlet at least partially from the attic below.

10. The roof structure of claim 9 and wherein each support baffle is hingedly attached to the blower adjacent a side of the outlet.

11. The roof structure of claim 9 and wherein the support baffles and the baffle wings of the support baffles are sized to cover the ridge slot opening and the blower opening in the vicinity of the blower.

12. The roof structure of claim 11 and wherein at least one of the support baffles is configured to fold over the ridge of the roof structure.

13. The roof structure of claim 1 and wherein the blower contains at least one impeller disposed at an angle between about zero degrees and about ninety degrees with respect to the ridge.

14. The roof structure of claim 13 and further comprising two impellers contained within the blower.

15. The roof structure of claim 14 and wherein the two impellers are disposed at different angles with respect to the ridge.

16. The roof structure of claim 13 and wherein the impeller is disposed generally between a pair of roof rafters.

17. The roof structure of claim 13 and wherein the impeller is disposed generally below the roof rafters.

18. The roof structure of claim 13 and wherein a length of the outlet of the blower is longer than a length of the impeller.

19. The roof structure of claim 13 and wherein a length of the outlet of the blower is shorter than a length of the impeller.

20. The roof structure of claim 1 and wherein the blower is powered by an electric motor and the electric motor is configured to be driven by a source of power selected from the group consisting essentially of a source of solar power, a ganged source of solar power, household electric service, or combinations thereof.

21. The roof structure of claim 1 and further comprising a ridge beam extending along the centerline of the ridge, the roof rafters extending downwardly from the ridge beam.

22. The roof structure of claim 21 and wherein the blower is mounted to one side of the ridge beam.

23. A method of ventilating an attic space below a gable roof having a roof ridge, the method comprising the steps of:

(a) forming a ridge slot along one side of the roof ridge communicating with the attic space;

(b) expanding the ridge slot at a predetermined location along the length thereof to form a blower opening;

(c) mounting a blower within the blower opening, with the blower configured to draw air from the attic space through a blower inlet and exhaust the air away from the ridge slot through a blower outlet;

(d) covering the ridge slot and the blower with a ridge vent; and (e) operating the blower to exhaust attic air through the ridge vent;

wherein the roof includes a ridge beam extending along the roof ridge and where in step (b) the blower opening is formed on one side of the ridge beam.

24. The method of claim 23 and wherein step (c) comprises lowering the blower through the blower opening and securing the blower in place.

25. The method of claim 23 and further comprising the step of disposing at least one baffle about the blower outlet with the baffle at least partially covering the blower opening and the ridge slot to isolate the blower outlet at least partially from the attic space.

26. The method of claim 25 and wherein the at least one baffle is mounted to the blower and wherein step (c) comprises lowering the blower into the blower opening and attaching the at least one baffle to the roof deck.

27. A roof structure comprising:

a roof deck sloping downwardly from a roof ridge having a centerline;

a ridge slot opening formed in the roof deck extending at least partially along and to either side of the centerline of the roof ridge, the ridge slot opening having an expanded portion at a predetermined location along the length thereof defining a blower opening, the blower opening having a width greater than a width of the ridge slot opening;

a tangential fan mounted in the blower opening beneath the roof deck and offset to one side of the centerline of the roof ridge;

the tangential fan containing at least one elongated impeller and having an inlet beneath the roof deck and an outlet configured to direct air away from the ridge slot opening; and a ridge vent extending along and covering the ridge slot opening;

the fan, when operated, drawing in air from an attic space below the roof deck, channeling the air upwards along the one side of the centerline of the ridge, and exhausting the air through the ridge vent.

28. The roof structure of claim 27 and further comprising a blower opening formed at the predetermined location along the ridge slot opening and wherein the tangential fan is mounted in the blower opening.

29. The roof structure of claim 27 and further comprising at least one support baffle disposed around the outlet of the tangential fan and at least partially covering the ridge slot opening in the vicinity of the fan to isolate the outlet from an attic space below the roof deck.

30. The roof structure of claim 29 and wherein the at least one support baffle is rotatably hinged to the tangential fan adjacent the outlet and is secured to the roof deck to fix the tangential fan in place.

31. The roof structure of claim 27 and where the at least one impeller comprises two or more impellers.

32. The roof structure of claim 27 and further comprising a ridge beam extending along the roof ridge and wherein the tangential fan is mounted to one side of the ridge beam.

* * * * *